US010634324B2

(12) United States Patent
Shim

(10) Patent No.: US 10,634,324 B2
(45) Date of Patent: Apr. 28, 2020

(54) LED-BASED ILLUMINATION ASSEMBLY WITH ADJUSTABLE IRRADIATION ANGLE

(71) Applicant: Young Chel Shim, Hwaseong-si (KR)

(72) Inventor: Young Chel Shim, Hwaseong-si (KR)

( * ) Notice: Subject to any disclaimer, the term of this patent is extended or adjusted under 35 U.S.C. 154(b) by 302 days.

(21) Appl. No.: 15/624,913

(22) Filed: Jun. 16, 2017

(65) Prior Publication Data

US 2018/0010776 A1 Jan. 11, 2018

(30) Foreign Application Priority Data

Jul. 5, 2016 (KR) ..... 10-2016-0084623

(51) Int. Cl.

| | |
|---|---|
| ***F21V 21/14*** | (2006.01) |
| ***F21V 14/02*** | (2006.01) |
| ***F21V 15/01*** | (2006.01) |
| ***F21V 17/16*** | (2006.01) |
| ***F21V 23/00*** | (2015.01) |
| ***F21V 3/02*** | (2006.01) |
| ***F21K 9/65*** | (2016.01) |
| ***F21K 9/232*** | (2016.01) |
| ***F21V 29/77*** | (2015.01) |

(Continued)

(52) U.S. Cl.

CPC ..... *F21V 21/14* (2013.01); *F21K 9/232* (2016.08); *F21K 9/65* (2016.08); *F21V 3/02* (2013.01); *F21V 14/02* (2013.01); *F21V 15/01* (2013.01); *F21V 17/16* (2013.01); *F21V 23/001* (2013.01); *F21V 29/77* (2015.01); *F21V 3/00* (2013.01); *F21Y 2115/10* (2016.08)

(58) Field of Classification Search

CPC .... F21S 4/24; F21K 9/232; F21K 9/65; F21V 14/02; F21V 21/14; F21V 29/77

See application file for complete search history.

(56) References Cited

U.S. PATENT DOCUMENTS

2015/0098228 A1* 4/2015 Simon ..... F21K 9/27 362/311.02
2016/0258600 A1* 9/2016 Jain ..... F21V 14/02

FOREIGN PATENT DOCUMENTS

JP 2015-099738 A 5/2015
KR 10-2010-0076289 A 7/2010

(Continued)

*Primary Examiner* — Joseph L Williams
*Assistant Examiner* — Jacob R Stern
(74) *Attorney, Agent, or Firm* — Jake K. Lee

(57) ABSTRACT

A LED (light-emitting diode)-based illumination assembly with an adjustable irradiation angle comprises a conductive threaded protrusion protruding from a hollow cylindrical body and threaded to an electrical bulb-type socket; a vertical elongate guide rod protruding from the base sub-assembly; a fixed LED-module support fixed to a distal end of the vertical elongate guide rod; a movable LED-module support configured to move along the vertical elongate guide rod; a plurality of LED-based illumination modules; a plurality of elongate elastic plate; an irradiation angle adjustment mechanism, wherein the irradiation angle adjustment mechanism is configured to allow operative connection between an outer circumferential surface of the hollow cylindrical body of the base sub-assembly and the movable LED-module support, wherein the irradiation angle adjustment mechanism is configured to allow adjustment of an irradiation angle of the LED-based illumination modules to a selected angle via the operative connection.

10 Claims, 10 Drawing Sheets

(51) Int. Cl.
*F21V 3/00* (2015.01)
*F21Y 115/10* (2016.01)

(56) References Cited

FOREIGN PATENT DOCUMENTS

KR 10-2010-0125128 A 11/2010
KR 10-2016-0048247 A 5/2016

* cited by examiner

LED-BASED ILLUMINATION ASSEMBLY WITH ADJUSTABLE IRRADIATION ANGLE

CROSS-REFERENCE TO RELATED APPLICATION

This application claims the benefit of Korean patent application No. 10-2016-0084623 filed on Jul. 5, 2016, the entire content of which is incorporated herein by reference for all purposes as if fully set forth herein.

BACKGROUND

Field of the Present Disclosure

The present disclosure relates to a LED-based illumination assembly with an adjustable irradiation angle. More particularly, the present disclosure relates to a LED-based illumination assembly with an adjustable irradiation angle where, when a number of LED-based illumination modules are fabricated using light emitting diodes (LEDs) with low heat generation and low power consumption, and, then, using these modules, various lighting devices with lamp shapes (for example, a stairway light, a floodlight, a streetlight, a security light, a landscape light, an illumination light for illuminating a house or a house or a factory, etc.) are produced, a light irradiation angle of the LED-based illumination modules can be arbitrarily adjusted based on the installation height of the lighting device, the purpose of use of the lighting device, and the coupling state thereof, etc. without installing expensive lenses having different light irradiation angles, thereby to prevent the occurrence of costs due to lens molding and lens stocking, and thereby to allows light from each LED-based illumination module to be adjusted very simply and precisely to the desired angle, and thereby allow improved reliability of the adjustment of the angle of light irradiation, and the energy saving.

Discussion of Related Art

Conventionally, mercury lamps or sodium lamps were mainly used for security lamps, street lamps, and factory and house lamps. In this case, there is a problem that the energy consumption is larger relative to the brightness, and the light amount is rapidly lowered with time due to the short life time.

Particularly, since mercury lamps use mercury gas, they have a problem of causing environmental pollution during disposal.

Therefore, in recent years, an illumination lamp using a light emitting diode (LED) having a short power consumption and a long life has been developed and employed.

In this connection, the light emitting diode has a number of advantages including fast response speed, low power consumption, and long lifetime. These light emitting diodes generate injected carriers (electrons or majors) using the P-N junction structure of semiconductors and emit light by recombination of these carriers. This LED has a power consumption of about 1/10 of that of a conventional incandescent lamp and a halogen lamp, and has a merit that the electric energy can be greatly reduced.

Particularly, when a large amount of electric power is required, such as a traffic signal lamp, a security lamp or a street lamp, a floodlight, a landscape lamp, a factory, and a lamp illuminating a house or a house, replacing a sodium lamp or a mercury lamp with the light-emitting diodes is very effective in reducing power consumption.

However, in the light emitting diode lighting apparatus, due to the characteristics of the LED, the irradiated light has a linearity. Therefore, the irradiation area is narrow, and various lighting devices using the LED lamp have a limited uniform illuminance and a limited light distribution area.

In addition, the LED lamp, the LED-based illumination modules, and the like are provided with lenses for irradiating light having a directivity in a predetermined angle. Such a lens is basically formed individually for each of the predetermined angles. A lens having a desired light irradiation angle is installed on the front side of the LEDs based on the object of the illumination device, the installation position thereof, and the like.

However, even in the case of the same illuminator made of LED as described above, the range of light irradiation differs depending on the installation height of the illuminator, the position thereof, the installation purpose thereof, and the like. Thus, the uniform illuminance and the light distribution area become changed. When installing each lighting equipment, a lens having a desired irradiation angle is selected among the lenses having different irradiation angles (normally, the lenses are formed at intervals of 5 degrees from 5 degrees to 60 degrees) depending on the height, the position and the purpose of the installation of the lighting equipment, etc.

Thus, the lenses should be in advance formed at intervals of 5 degrees from 5 degrees to 60 degrees.

This increases the cost of the lens mold (in fact, the lens mold requires a high level of technology and is expensive), and the costs of the lens itself and the stockpile thereof incur, resulting in a high production cost.

In addition, when the illuminating device is to be installed in a specific place, the specialist carries lenses having different illuminating angles, selects a lens having a necessary illuminating angle based on the installation place and the surrounding situation, and replaces/installs the selected lens to the illumination device. This requires a high level of expertise, resulting in labor costs. In the case of a lighting device with several LED-based illumination modules, the amount of light for each of the LED-based illumination modules cannot be adjusted arbitrarily. Often, it may necessary to reasonably adjust and utilize the light quantity in accordance with the installation place, situation, purpose, etc. of the lighting equipment. However, for example, when a lighting device is installed close to a wall, the light emitted from the LED-based illumination modules thereof in a position cannot be directed to a location far away from the wall. There is a problem that energy cannot be saved.

Accordingly, in the prior art, Korean Patent No. 10-1074687 discloses a lighting apparatus having the following configuration. A lighting device is provided to selectively control the radiation angle of a body including a light source by forming an angle controller on both sides of a bracket. To this end, a bracket is fixed to a mounting rod. A main body rotates around the bracket. The main body comprises a guide corresponding to a guide groove of the bracket. An angle controller controls the radiation angle of the body. The angel controller includes a sliding groove formed on the bracket and a moving unit with a plurality of saw-teeth.

However, this document does not disclose a configuration in which, in a lighting apparatus including several light sources, the light irradiation angle for each light source is individually adjusted. In this document, a way to adjust the angle of two bodies with two light sources is disclosed. Therefore, the amount of light cannot be reasonably adjusted depending on the installation place, situation, purpose, etc.

of the lighting equipment. Also, energy savings cannot be achieved. Further, the structure for installing the angle adjusting means between the main body and the bracket is very complicated. In order to further include an angle adjusting means for adjusting the light irradiation angle, the main body and the bracket must be newly modified. This causes a problem that the production cost of the product itself increases due to unnecessary mold production cost.

Further, in the prior art, Korean Patent No. 10-0971611 discloses a road lighting having the following configuration. A street lighting lamp is provided to easily obtain a required amount of illuminance for an installation place by controlling the angle of a lighting unit through a driving motor. A driving part is arranged inside a case. The driving part comprises a drive motor and a screw. An adjustment boss is moved upward and downward with the driving part. A second lighting unit is arranged in both sides of a first lighting unit. The second lighting unit is hinge-coupled with the first lighting unit. A plurality of LEDs are installed in each lighting unit. A connection bar is rotatably connected to the rear side of the second lighting unit.

However, in such a road lighting lamp in the above document, a separate driving motor is used to adjust the light irradiation direction for a plurality of light emitting units. Therefore, the production cost is increased unnecessarily, and the failure rate is increased. The lighting device itself is getting bigger. In particular, the light irradiation angles for a plurality of light emitting units cannot be individually adjusted. Instead, two illumination units symmetrically installed on both sides are combined to adjust the light irradiation angle for the combination at the same time. Therefore, the amount of light cannot be reasonably adjusted in accordance with the installation place and situation of the lighting apparatus. In addition, there is a problem that energy cannot be saved.

Further, in the prior art, Korean Patent No. 10-1274014 discloses a lighting device having the following configuration. A lighting device with a light irradiation angle adjustment function is provided to be equipped with an angle indication and setup function with a fixed angular interval from a light irradiation angle adjustment member, thereby easily adjusting the angle of light irradiation to a desired angel of light irradiation. A light irradiation angle adjustment unit comprises a first and second hinge connection units, a hinge rod, and a pair of hinge fixing elements. The first and the second hinge joint are formed to be crossed on a contact part of a main module installation plate and a peripheral module. The hinge rod comprises a hinge fixing element connection member. The hinge fixing element is screw-coupled to both end parts of the hinge rod. The hinge fixing elements fixes the first and the second hinge connection units on the hinge rod.

In the lighting apparatus having the above-described light irradiation angle adjusting function, the power supply converters are separately provided in the LED-based illumination modules respectively. Further, the irradiation angle adjustment mechanism is constituted by the first and second hinge fixing portions, and hinge rods, and the pair of hinge fixing elements. Holes for the hinge fixing elements may be drilled to have a predetermined depth at the center points of both end portions of the hinge fastener or a nut-coupling thread is formed on the outer circumferential surfaces of both ends of the hinge fastener. Further, the hinge fixing element shape-corresponds to the hole. The hinge fixing element includes a fastener or a bolt or a nut.

However, in the lighting apparatus having the light-emitting angle adjusting function having such a configuration, the LED-based illumination module itself incorporates the power supply converter. Therefore, the production cost is high, and the configuration of the irradiation angle adjustment mechanism is complicated. As a result, the weight of the lighting apparatus itself is increased, the manufacturing cost is increased, and the assembling time is long.

PRIOR ART DOCUMENT

Patent Literature

Patent Document 1: Korean Patent No. 10-1074687 (Oct. 12, 2011)

Patent Document 2: Korean Patent No. 10-0971611 (Jul. 14, 2010)

Patent Document 3: Korean Patent No. 10-1274014 (Jun. 5, 2013)

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter.

The present invention has been made in order to solve the problems of the related art. Thus, the present disclosure is to provide a LED-based illumination assembly with an adjustable irradiation angle where, when a number of LED-based illumination modules are fabricated using light emitting diodes (LEDs) with low heat generation and low power consumption, and, then, using these modules, various lighting devices with lamp shapes (for example, a stairway light, a floodlight, a streetlight, a security light, a landscape light, an illumination light for illuminating a house or a house or a factory, etc.) are produced, a light irradiation angle of the LED-based illumination modules can be arbitrarily adjusted based on the installation height of the lighting device, the purpose of use of the lighting device, and the coupling state thereof, etc. without installing expensive lenses having different light irradiation angles, thereby to prevent the occurrence of costs due to lens molding and lens stocking, and thereby to allows light from each LED-based illumination module to be adjusted very simply and precisely to the desired angle, and thereby allow improved reliability of the adjustment of the angle of light irradiation, and the energy saving.

In one aspect of the present disclosure, there is provided a LED (light-emitting diode)-based illumination assembly with an adjustable irradiation angle, the assembly comprising: a base sub-assembly, wherein the base sub-assembly includes a hollow cylindrical body having an inner space defined therein; a conductive threaded protrusion protruding from the hollow cylindrical body and threaded to an electrical bulb-type socket; a first annular ring fitted to an outer circumferential surface of the hollow cylindrical body; a cover plate closing an open top of the annular ring; and a power supply converter contained within the inner space; a vertical elongate guide rod protruding from a central portion of the cover plate of the base sub-assembly by a predetermined height; a fixed LED-module support fixed to a distal end of the vertical elongate guide rod; a movable LED-module support configured to move along the vertical elongate guide rod; a plurality of LED-based illumination modules, wherein each of the plurality of LED-based illumination modules includes a plurality of LEDs driven by a voltage output from the power supply converter, wherein the plurality of LED-based illumination modules are supported by the fixed and moveable LED-module supports; a plurality of elongate elastic plates, wherein one end of each of the plurality of elongate elastic plates is coupled to the fixed LED-module support, while the other end of each of the plurality of elongate elastic plates is coupled to the movable LED-module support, wherein each of the plurality of elongate elastic plates has a fixed portion secured to each of the LED-based illumination modules; an irradiation angle adjustment mechanism, wherein the irradiation angle adjustment mechanism is configured to allow operative connection between an outer circumferential surface of the hollow cylindrical body of the base sub-assembly and the movable LED-module support, wherein the irradiation angle adjustment mechanism is configured to allow adjustment of an irradiation angle of the LED-based illumination modules to a selected angle via the operative connection; and a LED-module protection sphere detachably installed to the base sub-assembly, wherein the protection sphere is configured to protect the LED modules, and transmit light generated from the LEDs therethrough, wherein when the movable LED-module support moves along the vertical elongate guide rod via the irradiation angle adjustment mechanism to allow pivotal movement of the LED-based illumination modules, the elongate elastic plates resiliently hold the LED-based illumination modules respectively so as to change the illumination angle of the LED-based illumination modules via the pivotal movement; wherein the fixed LED-module support is configured such that one end of each of the elongate elastic plates is removably coupled to the fixed LED-module support; and wherein the moveable LED-module support is configured such that the other end of each of the elongate elastic plates is removably coupled to the moveable LED-module support; or wherein said one end of each of the elongate elastic plates includes a first bendable portion, and said other end of each of the elongate elastic plates includes a second bendable portion, wherein each of the plurality of the LED-based illumination modules is pivotally coupled to the fixed LED-module support and the movable LED-module support via the first and second bendable portions respectively to allow pivotal moment of each of the plurality of the LED-based illumination modules to allow the adjustment of the irradiation angle thereof.

In one implementation, the fixed LED-module support includes a fixed annular body; a plurality of first radial branches extending radially outwardly from an outer circumferential surface of the fixed annular body, the first radial branches being spaced apart from each other by a predetermined distance, the first radial branches having different extensions; and a plurality of first LED-based module support portions formed at distal ends of the plurality of the first radial branches respectively; and wherein the movable LED-module support includes a movable annular body; a plurality of second radial branches extending radially outwardly from an outer circumferential surface of the movable annular body, the second radial branches being spaced apart from each other by a predetermined distance, the second radial branches having different extensions; and a plurality of second LED-based module support portions formed at distal ends of the plurality of the second radial branches respectively.

In one implementation, the irradiation angle adjustment mechanism includes: a plurality of pin-receiving portions integrally to the outer circumferential surface of the first annular ring and spacedly arranged at a predetermined angular distance along the outer circumferential surface of the first annular ring of the base sub-assembly, wherein each of the plurality of pin-receiving portions has an open inner side facing the outer circumferential surface of the first annular ring and has a vertical through-hole defined therein; a plurality of vertically elongate moveable pins vertically received respectively in the plurality of pin-receiving portions, wherein each pin have an L shape having a elongate vertical portion and a horizontal portion. Each pin has a linear worm gear integrally formed on an inner face of the vertical portion thereof, wherein a distal end of the vertical portion is secured to the movable LED-module support; and a second annular ring having a circular worm gear integral thereto on an inner circumferential surface thereof, wherein the circular worm gear is engaged with the linear worm gear of each of the vertically elongate moveable pins, wherein a plurality of protrusions are integrally formed on the outer circumferential surface of the second ring, wherein the second annular ring is rotatably disposed between stoppers outwardly protruding from and spaced arranged along the hollow cylindrical body of the base sub-assembly and fastener receiving portions vertically spaced from the stoppers and outwardly protruding from and spaced arranged along the hollow cylindrical body of the base sub-assembly.

In one implementation, each of the LED-based illumination modules includes: a first elongate plate having an elongate first flat portion, first lateral flanges integrally and inclinedly formed to both lateral sides of the flat portion, and elongate step-receiving grooves respectively formed in both edge portions of the lateral flanges, wherein cap-fixing holes are defined at both longitudinal ends of the first elongate plate, wherein the first elongate plate has a heat-dissipating function; a flexible printed circuit board having an array of the LEDs mounted thereon, wherein the circuit board is secured to an inner surface of the flat portion and the lateral flanges of the first elongate plate; a second elongate plate having a second flat portion and second lateral flanges integrally and inclinedly formed to both lateral sides of the first flat portion, wherein the first and second lateral flanges correspond to each other, wherein each elongate stopping step is integrally formed at each edge of the second lateral flanges, wherein the elongate stopping steps are slidably fitted into the elongate step-receiving grooves of the first elongate plate respectively, wherein the second elongate plate transmits light therethrough, wherein the printed circuit board is disposed between the second elongate plate and the first elongate plate, wherein the second elongate plate is configured to spread light beams from the LEDs; and upper and lower finish caps, each finish cap being provided with resilient engagement portion resiliently engaged in each of the cap-fixing holes of the first elongate plate, wherein the upper and lower finish caps are configured to block upper and lower ends of an elongated space defined between the second elongate plate and the first elongate plate respectively, wherein the finish caps are detachably mounted on the second elongate plate and the first elongate plate.

In one implementation, wherein a pair of spaced elongate elastic plate stoppers are integrally projected on the outer surface of the flat portion of the first elongate plate and extends in a length direction of the first elongate plate, wherein the fixed portion of the elongate elastic plate is resiliently fitted in between the a pair of spaced elongate elastic plate stoppers, wherein at least one of a plurality of power supply line receiving portions are integrally formed on the outer surface of the flat portion of the first elongate plate, wherein the power supply line receiving portions act as securing a power supply line for supplying the power supply voltage output from the power supply converter to each of the LED-based illumination modules.

In one implementation, each of the elongate elastic plates includes: the fixed portion fitted between the elongate elastic plate stoppers; and a bridge portion extending from the fixed portion and elastically connecting the fixed LED-module support or the movable LED-module support and the first elongate plate of each of the LED-based illumination modules, wherein the first and second bendable portions are formed at both ends of the fixed portion and the bridge portion respectively, wherein first to third width-reduction portions are formed between the fixed portion and the first bendable portion, between the bridge portion and the second bendable portion, and between the fixed portion and the bridge portion respectively.

In one implementation, power supply line receiving portions are integrally formed with the fixed LED-module support to receive a power supply line passing through the vertical elongate guide rod.

In one implementation, a power supply line passing-hole is defined at least one of the finish caps such that a power supply line passing through the vertical elongate guide rod passes through the power supply line passing-hole.

In one implementation, heat-dissipation fins are integrally protruded at regular intervals along and from the outer circumferential surface of the first annular ring of the base sub-assembly.

In one implementation, an inclined angle display portion for displaying the inclination angle of the LED-based illumination module is formed on the outer circumferential surface of the second annular ring, wherein an angle adjustment reference line is formed on the hollow cylindrical body of the base sub-assembly.

In accordance with the present disclosure, when a number of LED-based illumination modules are fabricated using light emitting diodes (LEDs) with low heat generation and low power consumption, and, then, using these modules, various lighting devices with lamp shapes (for example, a stairway light, a floodlight, a streetlight, a security light, a landscape light, an illumination light for illuminating a house or a house or a factory, etc.) are produced, a light irradiation angle of the LED-based illumination modules can be arbitrarily adjusted based on the installation height of the lighting device, the purpose of use of the lighting device, and the coupling state thereof, etc. without installing expensive lenses having different light irradiation angles, thereby to prevent the occurrence of costs due to lens molding and lens stocking, and thereby to allows light from each LED-based illumination module to be adjusted very simply and precisely to the desired angle, and thereby allow improved reliability of the adjustment of the angle of light irradiation, and the energy saving.

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

Figure 1:
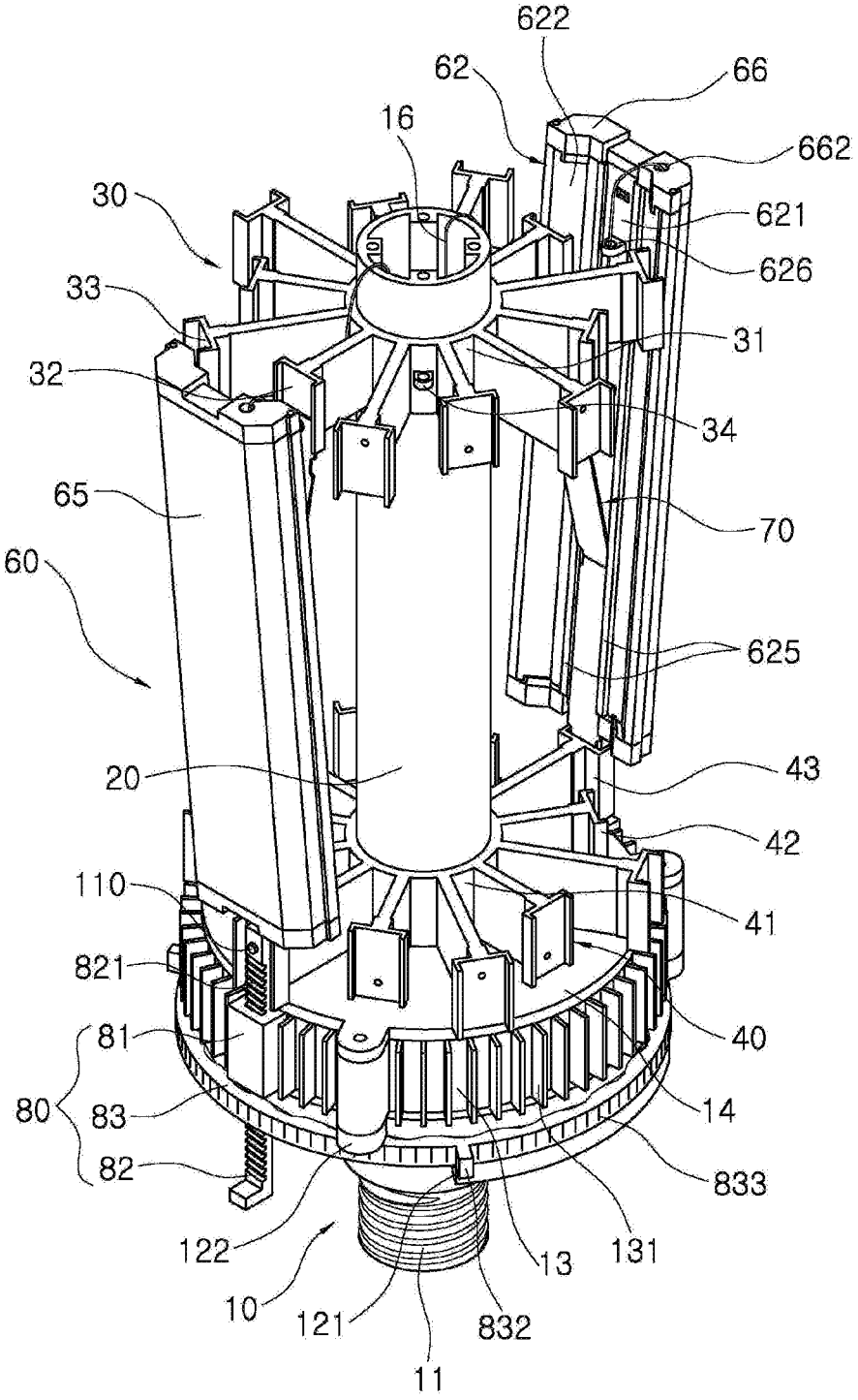
FIG. 1 is an assembled perspective view of a LED-based illumination assembly with an adjustable irradiation angle according to one embodiment of the present invention.

For simplicity and clarity of illustration, elements in the figures are not necessarily drawn to scale. The same reference numbers in different figures denote the same or similar elements, and as such perform similar functionality. Also, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

DETAILED DESCRIPTIONS

Examples of various embodiments are illustrated and described further below. It will be understood that the description herein is not intended to limit the claims to the specific embodiments described. On the contrary, it is intended to cover plate alternatives, modifications, and equivalents as may be included within the spirit and scope of the present disclosure as defined by the appended claims.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

As used herein, the use of "may" when describing embodiments of the present disclosure refers to "one or more embodiments of the present disclosure."

Figure 2:
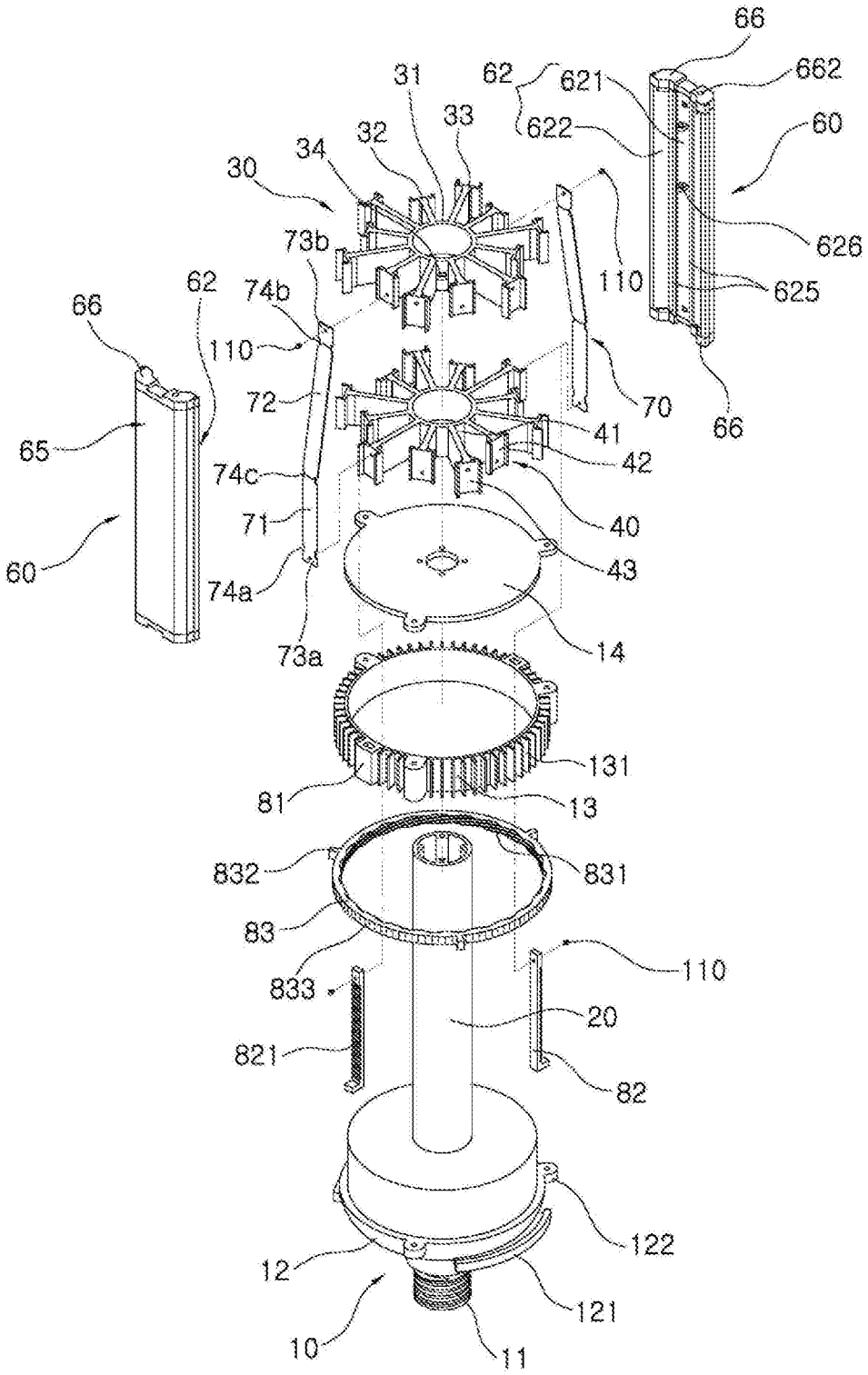
FIG. 2 is an exploded perspective view of a LED-based illumination assembly with an adjustable irradiation angle according to one embodiment of the present invention.
Figure 3:
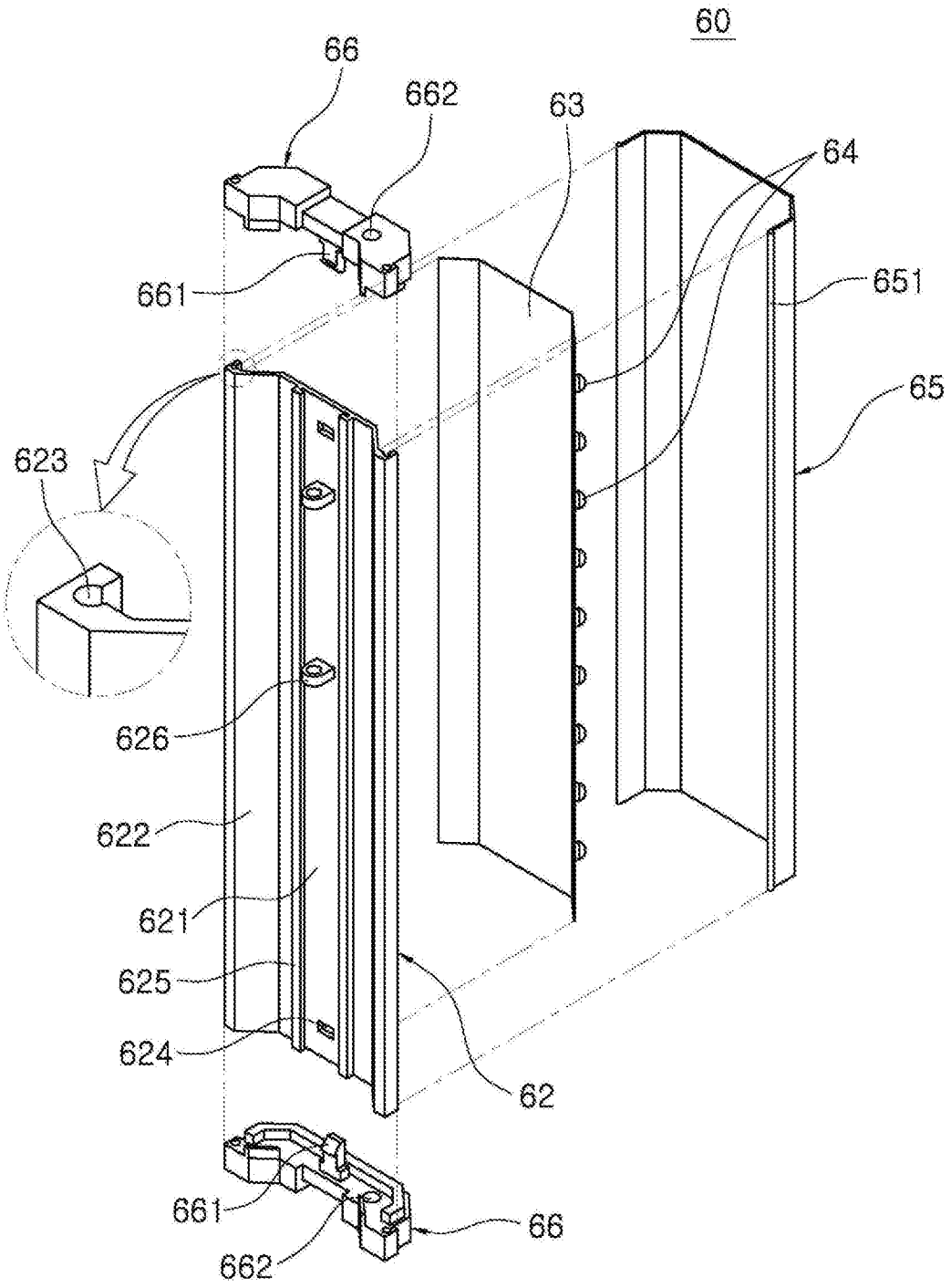
FIG. 3 is an exploded perspective view of a LED-based illumination module of an adjustable irradiation angle according to one embodiment of the present invention.
Figure 4:
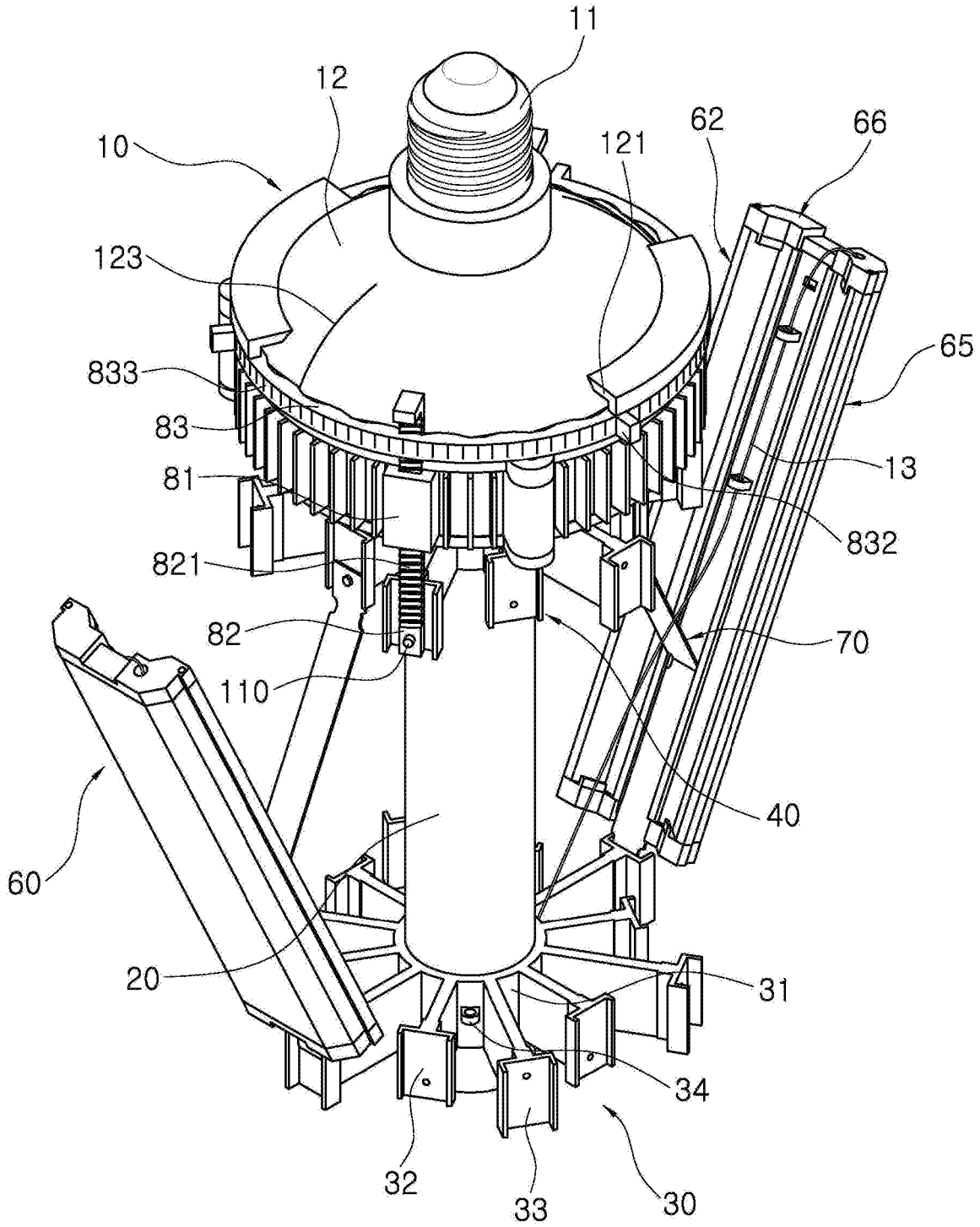
FIG. 4 is a perspective view in an operating state of a LED-based illumination assembly with an adjustable irradiation angle according to one embodiment of the present invention.

FIG. 1 is an assembled perspective view of a LED-based illumination assembly with an adjustable irradiation angle according to one embodiment of the present invention. FIG. 2 is an exploded perspective view of a LED-based illumination assembly with an adjustable irradiation angle according to one embodiment of the present invention. FIG. 3 is an exploded perspective view of a LED-based illumination module of an adjustable irradiation angle according to one embodiment of the present invention. FIG. 4 is a perspective view in an operating state of a LED-based illumination assembly with an adjustable irradiation angle according to one embodiment of the present invention.

Figure 5:
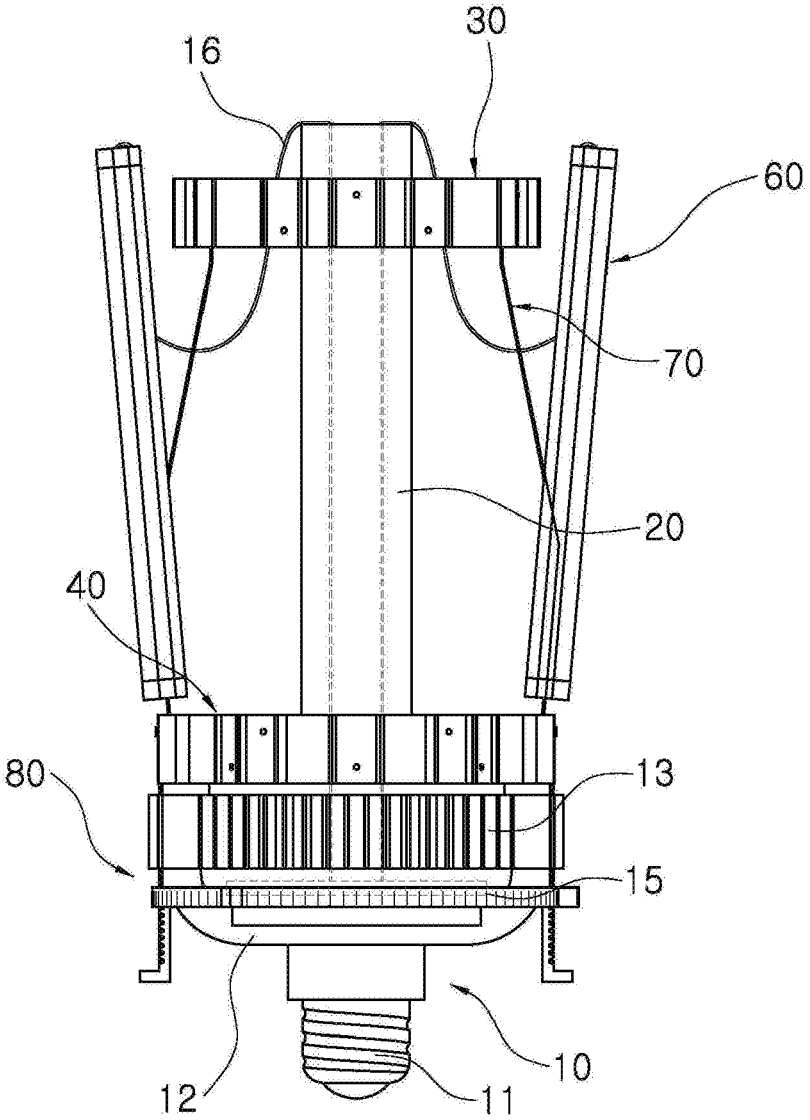
FIG. 5 is a front view of a LED-based illumination assembly with an adjustable irradiation angle according to one embodiment of the present invention.
Figure 6:
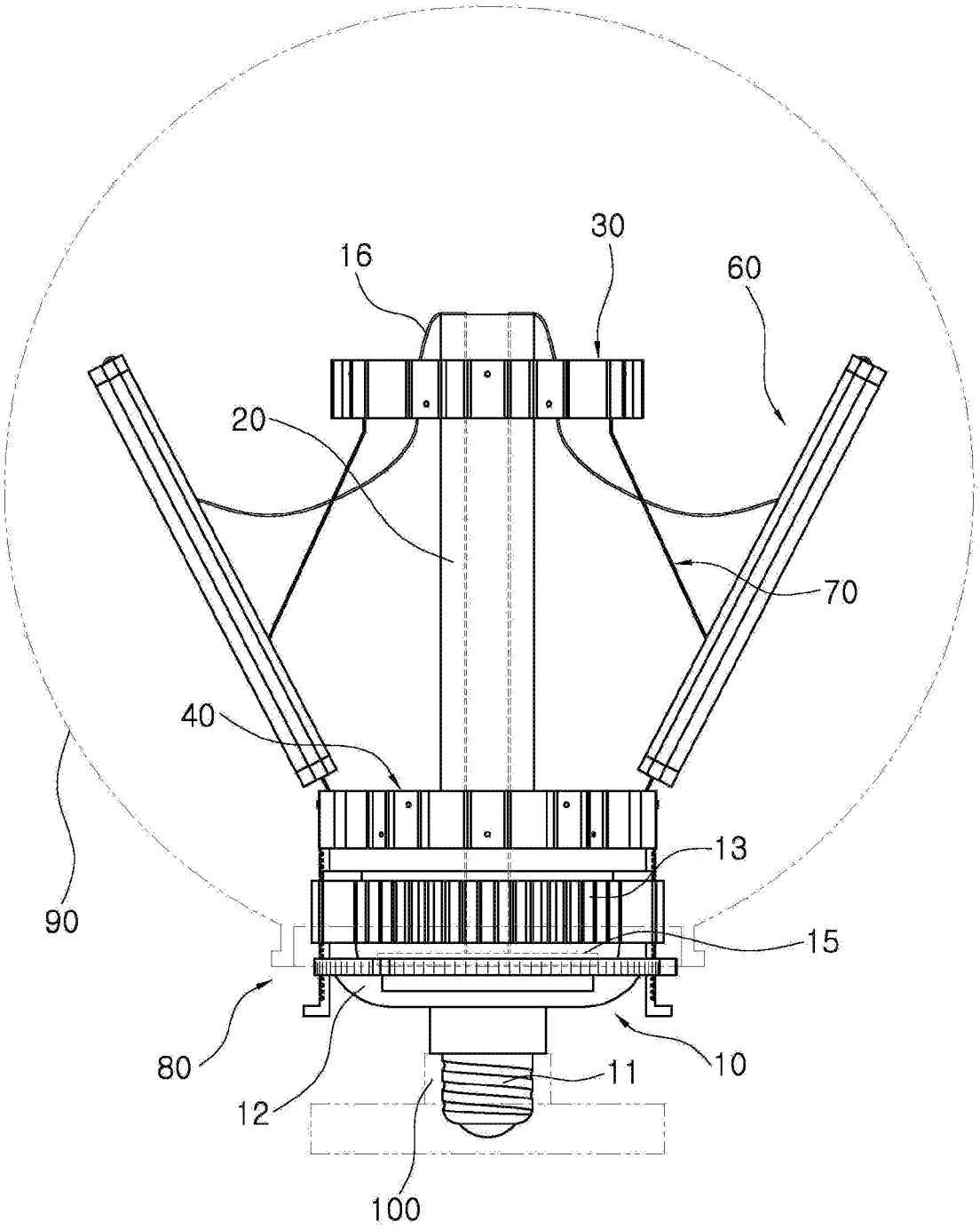
FIG. 6 is a front view in a completely-assembled state of a LED-based illumination assembly with an adjustable irradiation angle according to one embodiment of the present invention.
Figure 7:
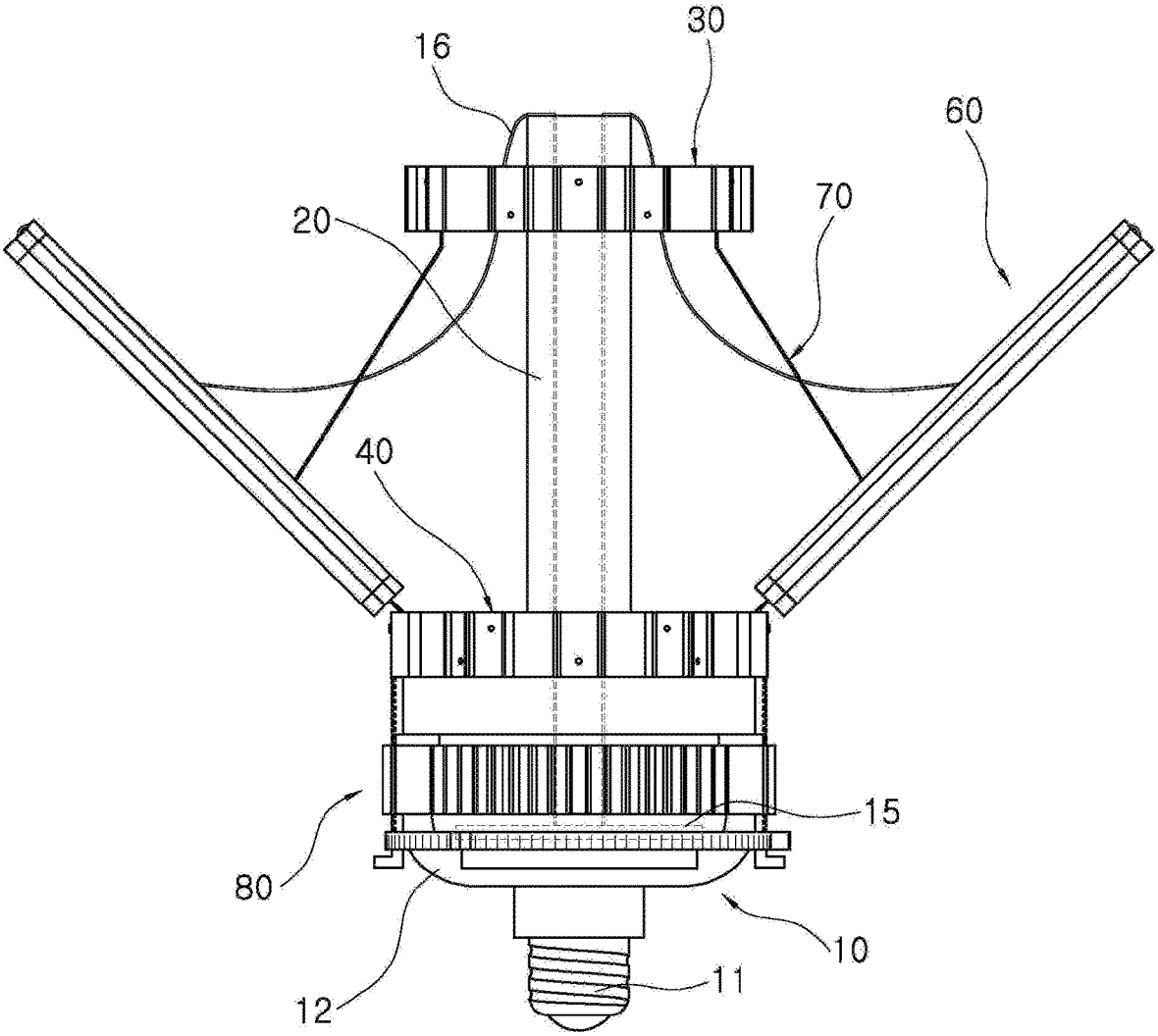
FIG. 7 is a front view in an operating state of the LED-based illumination assembly with an adjustable irradiation angle according to one embodiment of the present invention.

FIG. 5 is a front view of a LED-based illumination assembly with an adjustable irradiation angle according to one embodiment of the present invention. FIG. 6 is a front view in a completely-assembled state of a LED-based illumination assembly with an adjustable irradiation angle according to one embodiment of the present invention. FIG. 7 is a front view in an operating state of the LED-based illumination assembly with an adjustable irradiation angle according to one embodiment of the present invention.

Figure 8:
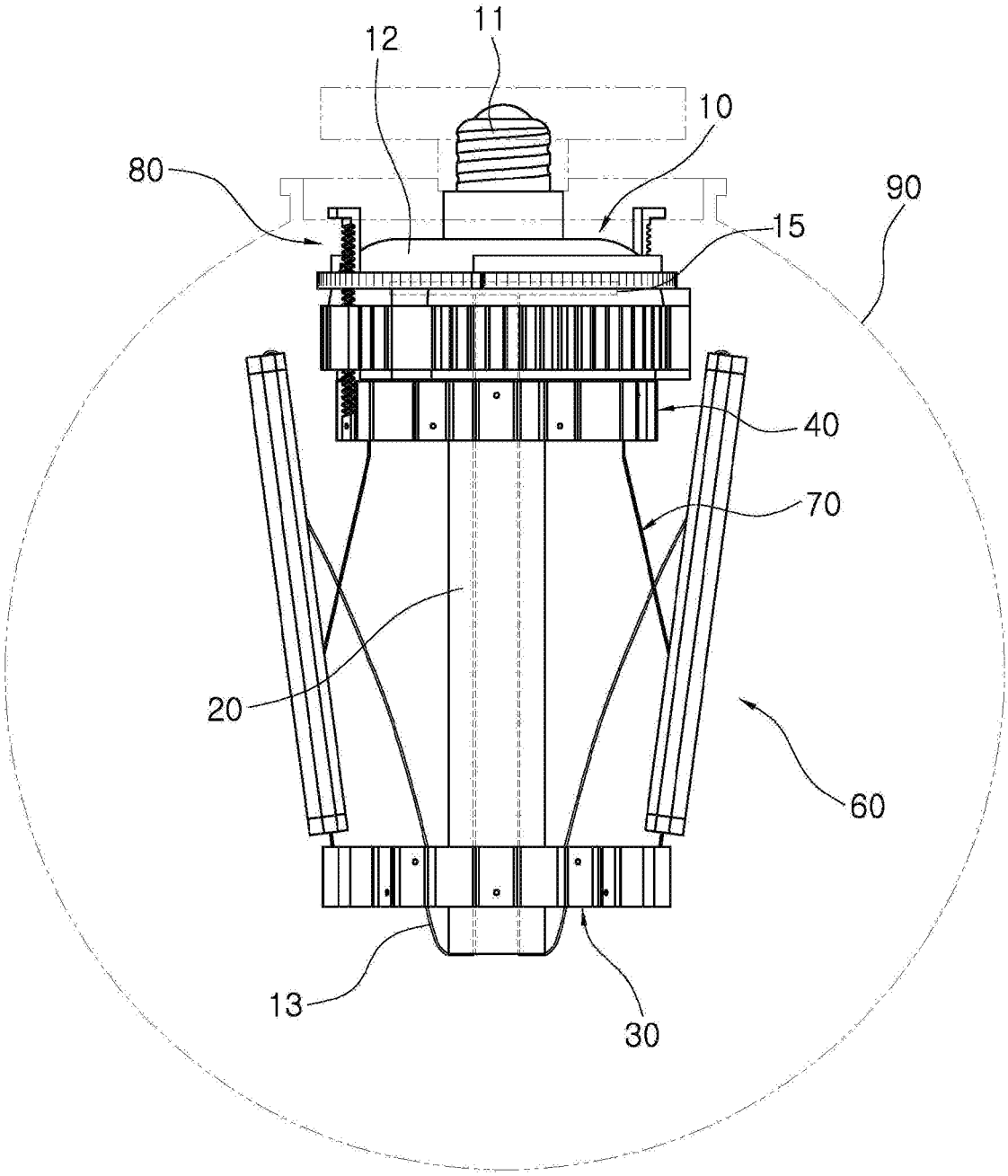
FIG. 8 is a front view of the LED-based illumination assembly with an adjustable irradiation angle according to another embodiment of the present invention.
Figure 9:
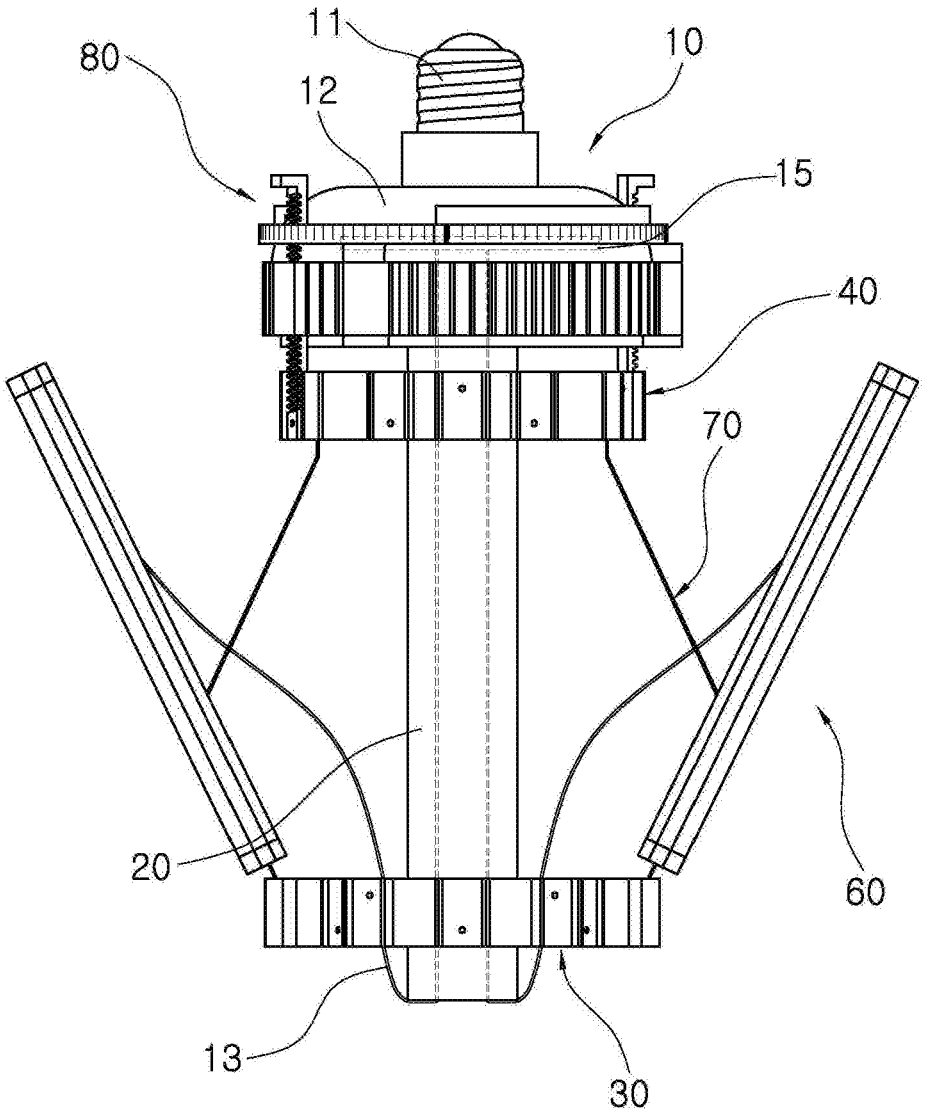
FIG. 9 is a front view in a completely-assembled state of a LED-based illumination assembly with an adjustable irradiation angle according to another embodiment of the present invention.
Figure 10:
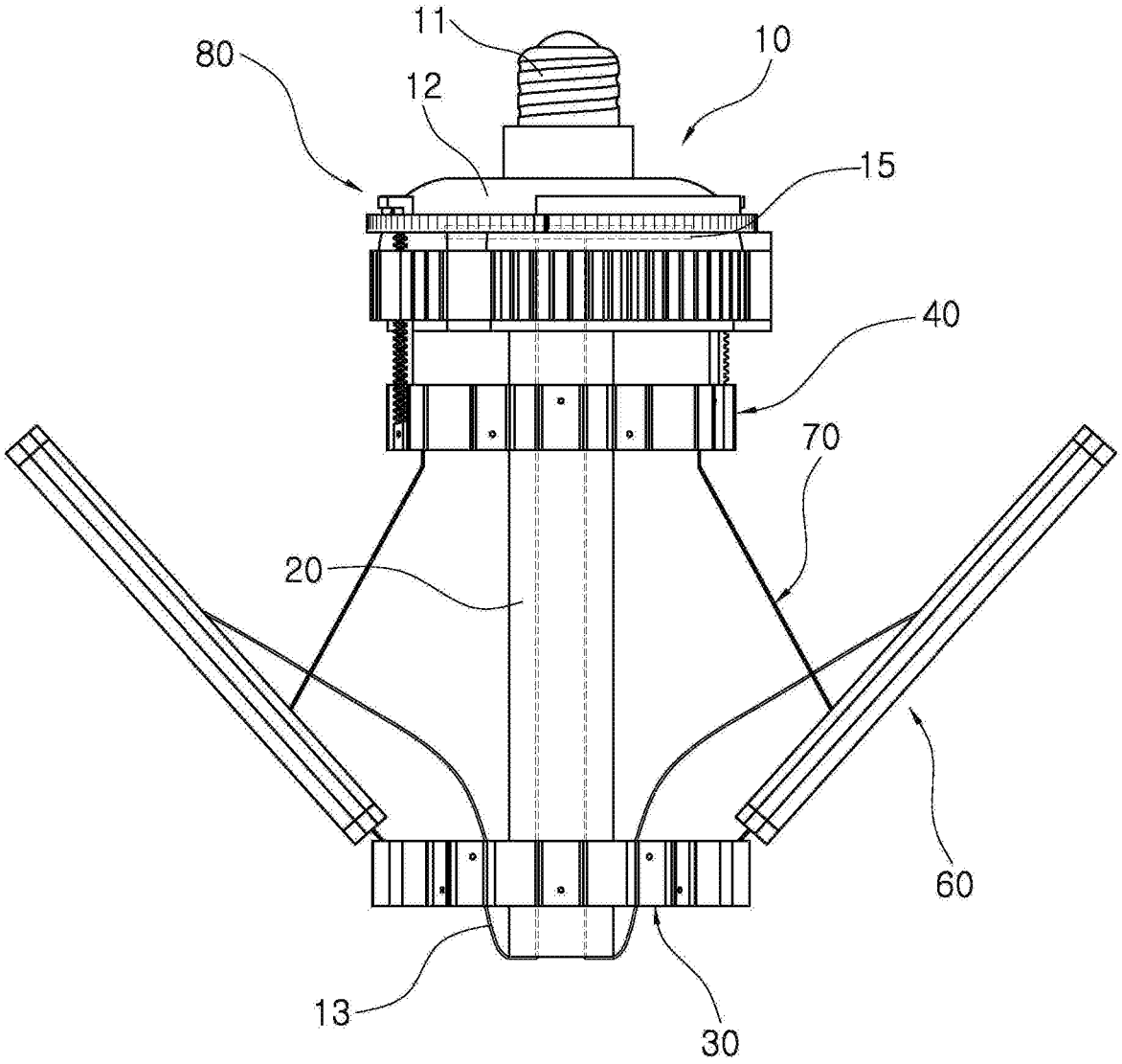
FIG. 10 is a front view in an operating state of a LED-based illumination assembly with an adjustable irradiation angle according to another embodiment of the present invention.

FIG. 8 is a front view of the LED-based illumination assembly with an adjustable irradiation angle according to another embodiment of the present invention. FIG. 9 is a front view in a completely-assembled state of a LED-based illumination assembly with an adjustable irradiation angle according to another embodiment of the present invention. FIG. 10 is a front view in an operating state of a LED-based illumination assembly with an adjustable irradiation angle according to another embodiment of the present invention.

A LED-based illumination assembly with an adjustable irradiation angle according to one embodiment of the present invention includes a base sub-assembly 10. The base sub-assembly 10 includes a hollow cylindrical body 12 having an inner space defined therein; a conductive threaded protrusion 11 protruding from the hollow cylindrical body 12 and threaded to an electrical bulb-type socket 100; an annular ring 13 fitted to an outer circumferential surface of the hollow cylindrical body 12; a cover plate 14 closing an open top of the first annular ring 13; and a power supply converter 15 contained within the inner space.

The LED-based illumination assembly with an adjustable irradiation angle according to one embodiment of the present invention includes a vertical elongate guide rod 20 protruding from a central portion of the cover plate 13 of the base sub-assembly 10 by a predetermined height.

The LED-based illumination assembly with an adjustable irradiation angle according to one embodiment of the present invention includes a fixed LED-module support 30. The fixed LED-module support 30 is fixed to a distal end of the vertical elongate guide rod 20. The fixed LED-module support 30 may be configured to support a plurality of LED-based modules 60. To this end, the fixed LED-module support 30 includes a fixed annular body 31; a plurality of first radial branches 32 extending radially outwardly from an outer circumferential surface of the fixed annular body 31, the first radial branches 32 being spaced apart from each other by a predetermined distance, the first radial branches 32 having different extensions; and a plurality of first LED-based module support portions 33 formed at distal ends of the plurality of the first radial branches 32 respectively.

In one embodiment, the fixed LED-module support 30 may be configured such that one end of each of elongate elastic plates 70 is removably coupled to each of the plurality of first LED-based module support portions 33 via each fastener 110. In another embodiment, the fixed LED-module support 30 may be configured such that each of the LED-based illumination modules 60 is coupled to a first bendable end 73*a* of each of the elongate elastic plates 70 via each fastener 110. When the first bendable end 73*a* is bended, an irradiation angle of the corresponding LED-based illumination module 60 varies.

The LED-based illumination assembly with an adjustable irradiation angle according to one embodiment of the present invention includes a movable LED-module support 40. The movable LED-module support 40 is configured to move along the vertical elongate guide rod 20. The movable LED-module support 40 may be configured to moveably support the plurality of LED-based modules 60. To this end, the movable LED-module support 40 includes a movable annular body 41; a plurality of second radial branches 42 extending radially outwardly from an outer circumferential surface of the movable annular body 41, the second radial branches 42 being spaced apart from each other by a predetermined distance, the second radial branches 42 having different extensions; and a plurality of second LED-based module support portions 43 formed at distal ends of the plurality of the second radial branches 42 respectively.

In one embodiment, the moveable LED-module support 40 may be configured such that the other end of each of the elongate elastic plates 70 is removably coupled to each of the plurality of second LED-based module support portions 43 via each fastener 110. In another embodiment, the movable LED-module support 30 may be configured such that each of the LED-based illumination modules 60 is coupled to a second bendable end 74*a* of each of the elongate elastic plates 70 via each fastener 110. When the second bendable end 74*a* is bended, an irradiation angle of the corresponding LED-based illumination module 60 varies. Additionally or alternatively, the movable LED-module support 40 moves along the vertical elongate guide rod 20, the irradiation angle of the LED-based illumination modules 60 varies.

The LED-based illumination assembly with an adjustable irradiation angle according to one embodiment of the present invention includes the multiple LED-based illumination modules 60. Each of the plurality of LED-based illumination modules 60 includes a plurality of LEDs (light emitting diode) 64 driven by a voltage output from the power supply converter 15. The plurality of the LED-based illumination modules 60 are pivotally coupled to the fixed LED-module support 30 and/or the movable LED-module support 40 via the first and/or second bendable ends 73*a* and 74*a* of the elongate elastic plates 70. Thus, when the movable LED-module support 40 is displaced by an irradiation angle adjustment mechanism 80, the irradiation angle of the LED-based illumination modules 60 varies.

The LED-based illumination assembly with an adjustable irradiation angle according to one embodiment of the present invention includes the multiple of the elongate elastic plates 70. One end of each of the plurality of elongate elastic plates 70 is coupled to each of the plurality of the first LED-based module support portions 33 of the fixed LED-module support 30. The other end of each of the plurality of elongate elastic plates 70 is coupled to each of the second LED-based module support portions 43 of the movable LED-module support 40. Each of the plurality of elongate elastic plates 70 includes a fixed portion 71, which is secured to each of the LED-based illumination modules 60. Each of the plurality of elongate elastic plates 70 has a bridge portion 72 extending from the fixed portion 71 and coupled to each of the plurality of the first LED-based module support portions 33. As the movable LED-module support 40 moves along the vertical elongate guide rod 20 via the irradiation angle adjustment mechanism 80, the elongate elastic plates 70 resiliently hold the LED-based illumination modules 60 respectively so as to change the illumination angle of the LED-based illumination modules 60.

The LED-based illumination assembly with an adjustable irradiation angle according to one embodiment of the present invention includes the irradiation angle adjustment mechanism 80. The irradiation angle adjustment mechanism 80 is configured to allow operative connection between the outer circumferential surface of the hollow cylindrical body 12 of the base sub-assembly 10 and the second LED-based module support portions 43 of the movable LED-module support 40. The irradiation angle adjustment mechanism 80 may be configured to allow the adjustment of the irradiation angle of the LED-based illumination modules 60 to a selected angle.

The LED-based illumination assembly with an adjustable irradiation angle according to one embodiment of the present invention includes a LED-module protection sphere 90. The LED-module protection sphere 90 is detachably installed to the base sub-assembly 10 and is configured to protect the LED modules 60, and transmit light generated from the LEDs 64 therethrough.

More specifically, the irradiation angle adjustment mechanism 80 includes a plurality of pin-receiving portions 81 integrally to the outer circumferential surface of the first annular ring 13 and spacedly arranged at a predetermined angular distance along the outer circumferential surface of the first annular ring 13 of the base sub-assembly 10. Each of the plurality of pin-receiving portions 81 has an open inner side facing the outer circumferential surface of the first annular ring 13 and has a vertical through-hole defined therein.

The irradiation angle adjustment mechanism 80 includes a plurality of vertically elongate moveable pins 82 vertically received respectively in the plurality of pin-receiving portions 81. The pin 82 has an L shape having a vertical portion and a horizontal portion. Each pin 82 has a linear worm gear 821 integrally formed on an inner face of the vertical portion thereof. A distal end of the vertical portion is secured to the second LED-based module support portions 43 of the movable LED-module support 40.

The irradiation angle adjustment mechanism 80 includes a second annular ring 83 having a circular worm gear 831 integral thereto on an inner circumferential surface thereof. The gear 831 is engaged with the linear worm gear 821 of each of the vertically elongate moveable pins 82. A plurality of protrusions 832 are integrally formed on the outer circumferential surface of the ring 83. With the circular worm gear 831 intermeshed with the linear worm gear of each of the vertically elongate moveable pins 82, the second annular ring 83 is rotatably disposed between stoppers 121 outwardly protruding from and spaced arranged along the hollow cylindrical body 12 of the base sub-assembly 10 and the lower fastener receiving portions 122 vertically spaced from the stoppers 121 and outwardly protruding from and spaced arranged along the hollow cylindrical body 12 of the base sub-assembly 10. Thus, the rotational motion of the second annular ring 83 is converted into the translational motion of the vertically elongate moveable pins 82.

The LED-based illumination modules 60 includes a first elongate plate 62 having an elongate flat portion 621, first lateral flanges 622 integrally and inclinedly formed to both lateral sides of the flat portion 621, and elongate step-receiving grooves 623 respectively formed in both edge portions of the lateral flanges 622. Cap-fixing holes 624 are defined at both longitudinal ends of the first elongate plate 62. The first elongate plate 62 has a heat-dissipating function and may be manufactured by extrusion using aluminum.

The LED-based illumination modules 60 includes a flexible printed circuit board 63 having an array of the LEDs 64 mounted thereon. The board 63 is secured to the inner surface of the flat portion 621 and the lateral flanges 622 of the first elongate plate 62.

The LED-based illumination modules 60 includes a second elongate plate 65 having a flat portion and second lateral flanges 623 integrally and inclinedly formed to both lateral sides of the flat portion, wherein the first and second lateral flanges 623 correspond to each other. Each elongate stopping step 651 is integrally formed at each edge of the lateral flanges 623. The elongate stopping steps 651 are slidably fitted into the elongate step-receiving grooves 623 of the first elongate plate 62. The second elongate plate 65 transmits light. The printed circuit board 63 is disposed between the second elongate plate 65 and the first elongate plate 62. The second elongate plate 65 is detachably coupled to the first elongate plate 62. The second elongate plate 65 is configured to spread light beams from the LEDs.

The LED-based illumination modules 60 includes a pair of finish caps 66 provided with resilient engagement portions 661 that are resiliently engaged in the cap-fixing holes 624 of the first elongate plate 62 respectively. The pair of finish caps 66 are configured to block upper and lower ends of an elongated space defined between the second elongate plate 65 and the first elongate plate 62. The pair of finish caps 66 are detachably mounted on the second elongate plate 65 and the first elongate plate 62.

In addition, a pair of spaced elongate elastic plate stoppers 625 are integrally projected on the outer surface of the flat portion 621 of the first elongate plate 62 and extends in a length direction of the first elongate plate 62, wherein the fixed portion of the elongate elastic plate 70 is resiliently fitted in between the a pair of spaced elongate elastic plate stoppers 625. At least one of a plurality of power supply line receiving portions 626 are integrally formed on the outer surface of the flat portion 621 of the first elongate plate 62. The power supply line receiving portions 626 act as securing a power supply line 16 for supplying the power supply voltage output from the power supply converter 15 to each of the LED-based illumination modules 60.

In addition, each of the elongate elastic plates 70 includes: the fixed portion 71 fitted between the elongate elastic plate stoppers 625; a bridge portion 72 extending from the fixed portion 71 and elastically connecting the fixed LED-module support 30 or the movable LED-module support 40 and the first elongate plate 62 of the LED-based illumination modules 60.

The first and second bendable portions 73*a* and 73*b* are formed at both ends of the fixed portion 71 and the bridge portion 72 respectively. First to third width-reduction portions 74*a*, 74*b*, and 74*c* are formed between the fixed portion 71 and the first bendable portion 73*a*, between the bridge portion 72 and the second bendable portion 73*b*, and between the fixed portion 71 and the bridge portion 72 respectively.

In one embodiment, power supply line receiving portions 34 may be integrally formed with the fixed LED-module support 30 to receive a power supply line 16 passing through the vertical elongate guide rod 20.

In one embodiment, a power supply line passing-hole 662 is defined at least one of the finish caps 66 such that a power supply line 16 passing through the vertical elongate guide rod 20 passes through the power supply line passing-hole 662.

In one embodiment, heat-dissipation fins 131 may be integrally protruded at regular intervals along and from the outer circumferential surface of the first annular ring 13 of the base sub-assembly 10.

In one embodiment, an inclined angle display portion 833 for displaying the inclination angle of the LED-based illumination module 60 is formed on the outer circumferential surface of the second annular ring 83. An angle adjustment reference line 123 is formed on the hollow cylindrical body 12 of the base sub-assembly 10.

Now, further details of the above-defined components of the LED-based illumination assembly with an adjustable irradiation angle according to the embodiments of the present invention will be described with reference to FIG. 1 to FIG. 10, First, the LED-based illumination assembly with an adjustable irradiation angle mainly includes the base sub-assembly 10, the vertical elongate guide rod 20, the fixed LED-module support 30, the movable LED-module support 40, the plurality of the based illumination modules 60, the plurality of the elongate elastic plates 70, the irradiation angle adjustment mechanism 80, and the LED-module protection sphere 90. As a result, the angle of light irradiation can be adjusted by adjusting the inclination angle of the LED-based illumination modules 60 without installing expensive lenses having different light irradiation angles. Such an irradiation angle may be controlled based on the installation height of the lighting assembly, applications of the lighting apparatus, etc.

In this connection, the base sub-assembly 10 includes the hollow cylindrical body 12 formed of a synthetic resin, the first annular ring 13 formed of aluminum excellent in heat dissipation, and a cover plate 14 having a circular plate shape. The hollow cylindrical body 12, the first annular ring 13, and the cover plate 14 are provided with a plurality of fasteners receiving portions (not shown) protruding therefrom to enable mutual disassembly and assembly therebetween through fasteners. On the center of the hollow cylindrical body 12, the conductive threaded protrusion 11 threaded into the electrical bulb-type socket 100 is protruded. In the inner space of the hollow cylindrical body 12, the power supply converter 15 for supplying power to the plurality of LED-based illumination modules 60 is received.

In order to smoothly dissipate heat generated from the power supply converter 15 to extend the life of the power supply converter 15, the plurality of heat-dissipation fins 131 may be integrally protruded from the outer peripheral surface of the first annular ring 13 of the base sub-assembly 10 formed of aluminum and may be arranged at a predetermined interval.

The vertical elongate guide rod 20 may be formed via injection-molding into a rod having a predetermined diameter. The vertical elongate guide rod 20 protrudes from the center of the cover plate 14 of the base sub-assembly 10 by a predetermined height. The movable LED-module support 40 moves along the vertical elongate guide rod 20. The fixed LED-module support 30 may be secured to the vertical elongate guide rod 20. The power supply line 16 may pass through the vertical elongate guide rod 20.

The fixed LED-module support 30 includes the fixed annular body 31; the plurality of first radial branches 32 extending radially outwardly from an outer circumferential surface of the fixed annular body 31, the first radial branches 32 being spaced apart from each other by a predetermined distance, the first radial branches 32 having different extensions; and the plurality of first LED-based module support portions 33 formed at distal ends of the plurality of the first radial branches 32 respectively. The fixed annular body 31 may be fixed to the distal end of the vertical elongate guide rod 20 via fasteners 110. The fixed LED-module support 30 may be formed of a synthetic resin.

In the first embodiment, as shown in FIG. 1 to FIG. 7, one end of each of the elongate elastic plates 70 may be detachably coupled to the first LED-based module support portion 33 of the first radial branch 32 of the fixed LED-module support 30 via the fastener 110. In the second embodiment, as shown in FIG. 8 to FIG. 10, said one end of each of the elongate elastic plates includes a first bendable portion, each of the plurality of the LED-based illumination modules is pivotally coupled to the first LED-based module support portion 33 of the fixed LED-module support 30 via the first bendable portions to allow pivotal moment of each of the plurality of the LED-based illumination modules to allow the adjustment of the irradiation angle thereof.

The power supply line receiving portions 34 may be integrally formed with the fixed LED-module support 30 to receive the power supply line 16 passing through the vertical elongate guide rod 20. Thus, the power supply line 16 may be fixed through the power supply line receiving portions 34 to allow smooth guides of the power supply line 16 toward each of the LED-based illumination modules 60.

The movable LED-module support 40 may be formed of a synthetic resin. The movable LED-module support 40 is configured to move along the vertical elongate guide rod 20. The movable LED-module support 40 may be configured to moveably support the plurality of LED-based modules 60. To this end, the movable LED-module support 40 includes the movable annular body 41; the plurality of second radial branches 42 extending radially outwardly from an outer circumferential surface of the movable annular body 41, the second radial branches 42 being spaced apart from each other by a predetermined distance, the second radial branches 42 having different extensions; and the plurality of second LED-based module support portions 43 formed at distal ends of the plurality of the second radial branches 42 respectively.

In the first embodiment, as shown in FIG. 1 to FIG. 7, the moveable LED-module support 40 may be configured such that the other end of each of the elongate elastic plates 70 is removably coupled to each of the plurality of second LED-based module support portions 43 via each fastener 110. In this case, when the movable LED-module support 40 moves along the vertical elongate guide rod 30 via the irradiation angle adjustment mechanism 80 to allow pivotal movement of the LED-based illumination modules 60, the elongate elastic plates 70 resiliently hold the LED-based illumination modules 60 respectively so as to change the illumination angle of the LED-based illumination modules 60 via the pivotal movement. In the second embodiment, as shown in FIG. 8 to FIG. 10, the movable LED-module support 30 may be configured such that each of the LED-based illumination modules 60 is coupled to the second bendable end 74*a* of each of the elongate elastic plates 70 via each fastener 110. In this case, when the second bendable end 74*a* is bended, the irradiation angle of the corresponding LED-based illumination module 60 varies. Additionally or alternatively, the movable LED-module support 40 moves along the vertical elongate guide rod 20, the irradiation angle of the LED-based illumination modules 60 further varies.

Each of the plurality of LED-based illumination modules 60 includes the plurality of LEDs (light emitting diode) 64 driven by a voltage output from the power supply converter 15. The plurality of the LED-based illumination modules 60 are pivotally coupled to the fixed LED-module support 30 and/or the movable LED-module support 40 via the first and/or second bendable ends 73*a* and 74*a* of the elongate elastic plates 70. Thus, when the movable LED-module support 40 is displaced by the irradiation angle adjustment mechanism 80, the irradiation angle of the LED-based illumination modules 60 varies. Each of the plurality of LED-based illumination modules 60 includes the first elongate plate 62, the second elongate plate 65, and the flexible printed circuit board 63 sandwiched therebetween and having the LEDs array thereon.

In this connection, the LED-based illumination modules 60 can generate a predetermined output, for example, 5 W, 8 W, 10 W and 20 W. Such an output can be freely adjusted depending on the installation location of the lighting equipment, the surrounding situation thereof, the installation purpose, or the installation type, etc.

The first elongate plate 62 may have the elongate flat portion 621, first lateral flanges 622 integrally and inclinedly formed to both lateral sides of the flat portion 621, and the elongate step-receiving grooves 623 respectively formed in both edge portions of the lateral flanges 622. The first elongate plate 62 may be formed of aluminum. The first elongate plate 62 may have a dimension complying with the target output of the present lighting device. The cap-fixing holes 624 are defined at both longitudinal ends of the first elongate plate 62. The first elongate plate 62 has a heat-dissipating function and may be manufactured by extrusion using aluminum.

In addition, the pair of spaced elongate elastic plate stoppers 625 are integrally projected on the outer surface of the flat portion of the first elongate plate and extends in a length direction of the first elongate plate 62, wherein the fixed portion 71 of the elongate elastic plate 70 is resiliently fitted in between the a pair of spaced elongate elastic plate stoppers. Further, the at least one of the plurality of power supply line receiving portions 625 are integrally formed on the outer surface of the flat portion of the first elongate plate 62, wherein the power supply line receiving portions 625 act as securing the power supply line 16 for supplying the power supply voltage output from the power supply converter 15 to each of the LED-based illumination modules 60.

The flexible printed circuit board 63 has the array of the LEDs 64 mounted thereon. The number of the LEDs may be selected based on the target output of each LED module 60.

The board 63 is secured to the inner surface of the flat portion 621 and the lateral flanges 622 of the first elongate plate 62. The flexible printed circuit board 63 may be flexible to conform to the inner surface of the flat portion 621 and the lateral flanges 622 of the first elongate plate 62. Thus, the flexible printed circuit board 63 may tightly contact the inner surface of the flat portion 621 and the lateral flanges 622.

In one embodiment, the arrays of the LEDs 64 are mounted on portions of flexible printed circuit board 63 corresponding to the flat portion 621 and the lateral flanges 622. Thus, light beams from the arrays of the LEDs 64 may emit in a directly front direction and in left and right angled directions. Thus, the light beams from the arrays of the LEDs 64 may be uniformly spread around each LED module 60.

The second elongate plate 65 is configured to spread light beams from the LEDs. To this end, the second elongate plate 65 may be made of a synthetic resin containing dispersed light spreading particles. The second elongate plate 65 has the second flat portion and second lateral flanges 623 integrally and inclinedly formed to both lateral sides of the flat portion, wherein the first and second lateral flanges 623 correspond to each other. Each elongate stopping step 651 is integrally formed at each edge of the lateral flanges 623. The second elongate plate 65 may be formed via injection-molding.

The elongate stopping steps 651 are slidably fitted into the elongate step-receiving grooves 623 of the first elongate plate 62. The second elongate plate 65 transmits light. The printed circuit board 63 is disposed between the second elongate plate 65 and the first elongate plate 62. The second elongate plate 65 is detachably coupled to the first elongate plate 62. Thus, light beams emitted from the arrays of the LEDs 64 in a directly front direction and in left and right angled directions may be incident on the second elongate plate 65 which, in turn, spread widely the light beams outwardly from the LEDs.

The pair of finish caps 66 provided with the resilient engagement portions 661 that are resiliently engaged in the cap-fixing holes 624 of the first elongate plate 62 respectively. The pair of finish caps 66 are configured to block the upper and lower ends of an elongated space defined between the second elongate plate 65 and the first elongate plate 62. The pair of finish caps 66 are detachably mounted on the second elongate plate 65 and the first elongate plate 62. Thus, the pair of finish caps 66 acts to protect the LEDs from outside contaminants or moistures.

The power supply line passing-hole 662 is defined at least one of the finish caps 66 such that the power supply line 16 passing through the vertical elongate guide rod 20 passes through the power supply line passing-hole 662. This allows smooth guides of the power supply line 16 toward each of the LED-based illumination modules 60.

In addition, as shown in FIG. 2, each of the elongate elastic plates 70 includes: the fixed portion 71; a bridge portion 72; the first and second bendable portions 73*a* and 73*b* formed at both ends of the fixed portion 71 and the bridge portion 72 respectively; and the first to third width-reduction portions 74*a*, 74*b*, and 74*c* formed between the fixed portion 71 and the first bendable portion 73*a*, between the bridge portion 72 and the second bendable portion 73*b*, and between the fixed portion 71 and the bridge portion 72 respectively. Each of the elongate elastic plates 70 including the above features may be monolithic. Each of the elongate elastic plates 70 may be embodied as an elastic steel plate such as a thin spring steel plate. However, the present invention is not limited thereto. In one embodiment, the bridge portion 72 is coupled to the fixed LED-module support 30 as shown in FIG. 2.

When the movable LED-module support 40 moves along the vertical elongate guide rod 20 via the irradiation angle adjustment mechanism 80 to allow pivotal movement of the LED-based illumination modules 60, the elongate elastic plates 70 resiliently hold the LED-based illumination modules 60 respectively via elastic bending so as to change and keep the illumination angle of the LED-based illumination modules 60 via the pivotal movement.

In this connection, the fixed portion 71 of the elongate elastic plate 70 is fitted between the elongate elastic plate stoppers 625 on the first elongate plate 62. The bridge portion 72 may extend from the fixed portion 71 and elastically connect the fixed LED-module support 30 or the movable LED-module support 40 and the first elongate plate 62 of the LED-based illumination modules 60.

The plurality of the LED-based illumination modules 60 are pivotally coupled to the fixed LED-module support 30 and/or the movable LED-module support 40 via the first and/or second bendable ends 73*a* and 74*a* of the elongate elastic plates 70. Further, the first and second bendable portions 73*a* and 73*b* have fastener passing holes defined therein. The first and second bendable portions 73*a* and 73*b* are formed at both ends of the fixed portion 71 and the bridge portion 72, respectively. The second bendable portion 73*b* of the bridge portion 72 is connected to one of the first LED-based module support portion 33 of the fixed LED-module support 30 or the second LED-based module support portion 43 of the moveable LED-module support 40 via the fasteners 110. The first bendable portion 73*a* of the fixed portion 71 is connected to the other of the first LED-based module support portion 33 of the fixed LED-module support 30 or the second LED-based module support portion 43 of the moveable LED-module support 40 via the fasteners 110.

In addition, the first to third width-reducing portions 74*a*, 74*b*, and 74*c* are formed between the fixed portion 71 and the first bendable end 73*a*, between the bridge portion 72 and the second bendable portion 73*b*, and between the fixed portion 71 and the bridge portion 72. The first to third width-reducing portions 74*a*, 74*b*, and 74*c* may be formed by cutting a groove on the lateral side of the corresponding portion. When the irradiation angle adjustment mechanism 80 is used to lift or lower the movable LED-module support 40 to change the tilt angle of the LED-based illumination modules 60, each of the first to third width-reducing portions 74*a*, 74*b*, and 74*c* is flexibly and smoothly bent without being cut, thereby to perform a hinge function.

As shown in FIG. 2, the irradiation angle adjustment mechanism 80 includes the plurality (e.g., 2 to 4) of vertically elongate moveable pins 82 vertically received respectively in the plurality of pin-receiving portions 81. The pin 82 has an L shape having a vertical portion and a horizontal portion. Each pin 82 has a linear worm gear 821 integrally formed on an inner face of the vertical portion thereof. A distal end of the vertical portion is secured to the second LED-based module support portions 43 of the movable LED-module support 40.

The vertically elongate moveable pins 82 lift and lower the movable LED-module support 40 directly. Accordingly, the tilt angle of the LED-based illumination modules 60 tilt-adjustably connected to the second LED-based module support portions 43 of the movable LED-module support 40 or the first LED-based module support portions 33 of the fixed LED-module support 30 can be adjusted. Thus, the light irradiation angle of the LEDs 64 installed in the LED-based illumination modules 60 can be directly adjusted to a desired angle as shown in FIGS. 4 to 10.

The irradiation angle adjustment mechanism 80 includes the second annular ring 83 having the circular worm gear 831 integral thereto on an inner circumferential surface thereof. The gear 831 is engaged with the linear worm gear 821 of each of the vertically elongate moveable pins 82. A plurality of protrusions 832 are integrally formed on the outer circumferential surface of the ring 83. With the circular worm gear 831 intermeshed with the linear worm gear of each of the vertically elongate moveable pins 82, the second annular ring 83 is rotatably disposed between stoppers 121 outwardly protruding from and spaced arranged along the hollow cylindrical body 12 of the base sub-assembly 10 and the lower fastener receiving portions 122 vertically spaced from the stoppers 121 and outwardly protruding from and spaced arranged along the hollow cylindrical body 12 of the base sub-assembly 10. Thus, the rotational motion of the second annular ring 83 is converted into the translational motion of the vertically elongate moveable pins 82.

The second annular ring 83 is rotated clockwise or counterclockwise on and along the outer circumferential surface of the hollow cylindrical body 12 of the base sub-assembly 10 by the user. This allows the vertically elongate moveable pins 82 to translate due to the mutual engagement between the linear worm gear of the vertically elongate moveable pins 82 and the circular worm gear 831 of the second annular ring 83. Thus, the moveable pins 82 are lifted or lowered.

The inclined angle display portion 833 for displaying the inclination angle of the LED-based illumination module 60 is formed on the outer circumferential surface of the second annular ring 83. The inclined angle display portion 833 depends on the ratios between the number of teeth and teeth pitch of the circular worm gear 831 of the second annular ring 83 and the number of teeth and teeth pitch of the linear worm gear of the vertically elongate moveable pins 82. The angle adjustment reference line 123 relative to the inclined angle display portion 833 is formed on the hollow cylindrical body 12 of the base sub-assembly 10.

Accordingly, when the user rotates the second annular ring 83 of the irradiation angle adjustment mechanism 80 to lift or lower the vertically elongate moveable pins 82, thereby adjusting the inclination angle of the LED-based illumination modules 60, the second annular ring 83 is rotated by a desired angle on the basis of the angle adjustment reference line 123 formed on the hollow cylindrical body 12 of the base sub-assembly 10 so that the angle displayed on the inclined angle display portion 833 matches a desired angle. Thereby, the inclination angle of the LED-based illumination modules 60 can be accurately and easily adjusted to the desired angle.

The LED-module protection sphere 90 is detachably installed to the base sub-assembly 10 and is configured to protect the LED modules 60, and transmit light generated from the LEDs 64 therethrough.

The base sub-assembly 10 may be inserted into the LED-module protection sphere 90. The LED-module protection sphere 90 may be removably connected to the base sub-assembly 10. The LED-module protection sphere 90 has a hole into which the base sub-assembly 10 can be inserted. The LED-module protection sphere 90 wraps and protects all of the above-defined internal components of the illumination assembly. As such, the LED-module protection sphere 90 can protect all of the internal components of the illumination assembly from external contaminants or moisture. In addition, the LED-module protection sphere 90 functions to smoothly transmit light emitted from the LED 64 to the outside.

In this connection, when the LED-module protection sphere 90 is to be coupled to the base sub-assembly 10 or to be separated from the base sub-assembly 10, following operation will be carried out. The operator rotates the second annular ring 83 clockwise or counter-clockwise, thereby lifting or lowering the movable LED-module support 40 through the vertically elongate moveable pins 82. As a result, the LED-based illumination modules 60 are folded or retracted toward the vertical elongate guide rod 20 as shown in FIGS. 1, 5 and 8. In the retracted state of the LED-based illumination modules 60, assembling the LED-module protection sphere 90 to the base sub-assembly 10 or separating it from the base sub-assembly 10 may be executed.

After coupling the LED-module protection sphere 90 to the base sub-assembly 10, the second annular ring 83 of the irradiation angle adjustment mechanism 80 is rotated in a direction opposite to the above-described direction, for example, counterclockwise or clockwise to lower or lift the movable LED-module support 40 via the vertically elongate moveable pins 82. Thus, in a state of the LED-based illumination modules 60 being inserted into the LED-module protection sphere 90, the inclination angle of the LED-based illumination modules 60 can be adjusted to a desired angle and to an unfolded or extended state. In this way, the light irradiation angle adjustment using the LED-based illumination assembly with the adjustable irradiation angle according to the present invention has been completed.

In one application of the LED-based illumination assembly with an adjustable irradiation angle according to the present invention which may be installed on a ceiling of a building such as installations of a streetlight, a security light, and a down light, where the illumination device is to be used for the purpose of irradiating the light from the ceiling toward the ground, the base sub-assembly 10 is positioned as the top of the LED-based illumination assembly, and the LED-based illumination modules 60 may be installed on the outer circumferential surface of the fixed LED-module support 30 fixed to the free end of the vertical elongate guide rod 20 installed right under the base sub-assembly 10. This is shown in FIG. 8 and FIG. 9.

On the contrary, when the LED-based illumination assembly with an adjustable irradiation angle according to the present invention is installed on a top of a lamp post or the like, such as a floodlight, as shown in FIG. 6, the base sub-assembly 10 is positioned as the bottom of the LED-based illumination assembly, and the LED-based illumination modules 60 may be installed on the outer circumferential surface of the movable LED-module support 40 moving up and down along the vertical elongate guide rod 20 extending upwardly in the vertical direction from the base sub-assembly 10.

According to the LED-based illumination assembly with an adjustable irradiation angle according to the present invention, each of the LED-based illumination modules may be driven by a single power supply converter. This can reduce the production cost of the LED-based illumination modules themselves. Further, by adjusting the inclination angle of the LED-based illumination modules, it is possible to adjust the angle of light irradiation depending on the installation height of the lighting device, the purpose of use of the lighting device, and the coupling state of the lighting device without installing expensive lenses having different light irradiation angles. Thus, it is possible to prevent the occurrence of costs due to lens molding and lens stocking. As a result, the production cost of the lighting device itself can be significantly reduced.

In addition, the output of the LED-based illumination assembly can be reasonably freely adjusted, depending on the installation location of the lighting assembly, the surrounding environment, the installation purpose, or the installation type. In addition, the irradiation angle adjustment mechanism allows light from each LED-based illumination module to be adjusted very simply and precisely to the desired angle. The reliability according to the adjustment of the angle of light irradiation can be greatly improved, and in particular, the energy saving can be achieved.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

What is claimed is:

1. A LED (light-emitting diode)-based illumination assembly with an adjustable irradiation angle, the assembly comprising:

a base sub-assembly including: a hollow cylindrical body having an inner space; a conductive threaded protrusion protruding from the hollow cylindrical body and threaded to an electrical bulb-type socket; a first annular ring having a cylindrical shape and fitted to an outer circumferential surface of the hollow cylindrical body; a cover plate closing an open top of the annular ring; and a power supply converter disposed in the inner space of the hollow cylindrical body, wherein the first annular ring is provided with a plurality of pin-receiving portions integrally formed on an outer circumferential surface thereof and spaced apart at a predetermined angular distance along a circumferential direction thereof;

a vertical elongate guide rod protruding from a central portion of the cover plate of the base sub-assembly by a predetermined height;

a fixed LED-module support fixed to an end of the vertical elongate guide rod;

a movable LED-module support configured to move along the vertical elongate guide rod;

a plurality of LED-based illumination modules, each including a plurality of LEDs driven by a voltage output from the power supply converter and supported by the fixed and moveable LED-module supports;

a plurality of elongate elastic plates, each having a fixed portion secured to each of the LED-based illumination modules, wherein opposite ends of each of the plurality of elongate elastic plates are coupled to the fixed and movable LED-module supports, respectively;

an irradiation angle adjustment mechanism configured to allow adjustment of an irradiation angle of the LED-based illumination modules to a selected angle; and a LED-module protection sphere detachably installed to the base sub-assembly to protect the LED modules and transmit light generated from the LEDs therethrough, wherein when the movable LED-module support moves along the vertical elongate guide rod via the irradiation angle adjustment mechanism to allow pivotal movement of the LED-based illumination modules, the elongate elastic plates resiliently hold the LED-based illumination modules respectively so as to change the illumination angle of the LED-based illumination modules via the pivotal movement;

wherein said opposite ends of each of the elongate elastic plates are each provided with a bendable portion to allow each of the plurality of the LED-based illumination modules to be pivotally coupled to the fixed LED-module support and the movable LED-module support to thereby allow the adjustment of the irradiation angle thereof.

2. The assembly of claim 1, wherein the fixed LED-module support includes:

a fixed annular body;

a plurality of first radial branches extending radially outwardly from an outer circumferential surface of the fixed annular body, the first radial branches being spaced apart from each other by a predetermined distance, the first radial branches having different extensions; and a plurality of first LED-based module support portions formed at distal ends of the plurality of the first radial branches respectively;

wherein the movable LED-module support includes:

a movable annular body;

a plurality of second radial branches extending radially outwardly from an outer circumferential surface of the movable annular body, the second radial branches being spaced apart from each other by a predetermined distance, the second radial branches having different extensions; and a plurality of second LED-based module support portions formed at distal ends of the plurality of the second radial branches respectively.

3. The assembly of claim 1, wherein the irradiation angle adjustment mechanism includes:

the plurality of pin-receiving portions integrally formed on the outer circumferential surface of the first annular ring and spacedly arranged at a predetermined angular distance along the outer circumferential surface of the first annular ring, the plurality of pin-receiving portions each having an open inner side facing the outer circumferential surface of the first annular ring and a vertical through-hole defined therein;

a plurality of vertically elongate moveable pins inserted in the plurality of pin-receiving portions, respectively, each pin having an L shape along a vertical direction and provided with a linear worm gear integrally formed on an inner face of an vertical portion thereof, wherein a distal end of the vertical portion is secured to the movable LED-module support; and a second annular ring having a circular worm gear integral thereto on an inner circumferential surface thereof, wherein the circular worm gear is engaged with the linear worm gear of each of the vertically elongate moveable pins, wherein a plurality of protrusions are integrally formed on the outer circumferential surface of the second ring, wherein the second annular ring is rotatably disposed between stoppers outwardly protruding from and spaced arranged along the hollow cylindrical body of the base sub-assembly and fastener receiving portions vertically spaced from the stoppers and outwardly protruding from and spaced arranged along the hollow cylindrical body of the base sub-assembly.

4. The assembly of claim 3, wherein an inclined angle display portion for displaying the inclination angle of the LED-based illumination module is formed on the outer circumferential surface of the second annular ring, wherein an angle adjustment reference line is formed on the hollow cylindrical body of the base sub-assembly.

5. The assembly of claim 1, wherein each of the LED-based illumination modules includes:

a first elongate plate having an elongate first flat portion, first lateral flanges integrally and inclinedly formed to both lateral sides of the flat portion, and elongate step-receiving grooves respectively formed in both edge portions of the lateral flanges, wherein cap-fixing holes are defined at both longitudinal ends of the first elongate plate, wherein the first elongate plate has a heat-dissipating function;

a flexible printed circuit board having an array of the LEDs mounted thereon, wherein the circuit board is secured to an inner surface of the flat portion and the lateral flanges of the first elongate plate;

a second elongate plate having a second flat portion and second lateral flanges integrally and inclinedly formed to both lateral sides of the first flat portion, wherein the first and second lateral flanges correspond to each other, wherein each elongate stopping step is integrally formed at each edge of the second lateral flanges, wherein the elongate stopping steps are slidably fitted into the elongate step-receiving grooves of the first elongate plate respectively, wherein the second elongate plate transmits light therethrough, wherein the printed circuit board is disposed between the second elongate plate and the first elongate plate, wherein the second elongate plate is configured to spread light beams from the LEDs; and upper and lower finish caps, each finish cap being provided with resilient engagement portion resiliently engaged in each of the cap-fixing holes of the first elongate plate, wherein the upper and lower finish caps are configured to block upper and lower ends of an elongated space defined between the second elongate plate and the first elongate plate respectively, wherein the finish caps are detachably mounted on the second elongate plate and the first elongate plate.

6. The assembly of claim 5, wherein a pair of spaced elongate elastic plate stoppers are integrally projected on the outer surface of the flat portion of the first elongate plate and extends in a length direction of the first elongate plate, wherein the fixed portion of the elongate elastic plate is resiliently fitted in between the a pair of spaced elongate elastic plate stoppers, wherein at least one of a plurality of power supply line receiving portions are integrally formed on the outer surface of the flat portion of the first elongate plate, wherein the power supply line receiving portions act as securing a power supply line for supplying the power supply voltage output from the power supply converter to each of the LED-based illumination modules.

7. The assembly of claim 6, wherein each of the elongate elastic plates includes:

the fixed portion fitted between the elongate elastic plate stoppers; and a bridge portion extending from the fixed portion and elastically connecting the fixed LED-module support or the movable LED-module support and the first elongate plate of each of the LED-based illumination modules, wherein the first and second bendable portions are formed at both ends of the fixed portion and the bridge portion respectively, wherein first to third width-reduction portions are formed between the fixed portion and the first bendable portion, between the bridge portion and the second bendable portion, and between the fixed portion and the bridge portion respectively.

8. The assembly of claim 5, wherein a power supply line passing-hole is defined at least one of the finish caps such that a power supply line passing through the vertical elongate guide rod passes through the power supply line passing-hole.

9. The assembly of claim 1, wherein power supply line receiving portions are integrally formed with the fixed LED-module support to receive a power supply line passing through the vertical elongate guide rod.

10. The assembly of claim 1, wherein heat-dissipation fins are integrally protruded at regular intervals along and from the outer circumferential surface of the first annular ring of the base sub-assembly.

* * * * *